US010662676B1

(12) United States Patent
Monroe et al.

(10) Patent No.: US 10,662,676 B1
(45) Date of Patent: May 26, 2020

(54) CONCEALED LATCH

(71) Applicants: Donald R. Monroe, Los Gatos, CA (US); Phil M. Hobson, Menlo Park, CA (US); John Raff, Menlo Park, CA (US); Albert J. Golko, Saratoga, CA (US); Matthew L. Brown, San Jose, CA (US); David J. Donohue, San Francisco, CA (US)

(72) Inventors: Donald R. Monroe, Los Gatos, CA (US); Phil M. Hobson, Menlo Park, CA (US); John Raff, Menlo Park, CA (US); Albert J. Golko, Saratoga, CA (US); Matthew L. Brown, San Jose, CA (US); David J. Donohue, San Francisco, CA (US)

(73) Assignee: Apple Inc., Cupertino, CA (US)

( * ) Notice: Subject to any disclaimer, the term of this patent is extended or adjusted under 35 U.S.C. 154(b) by 427 days.

(21) Appl. No.: 15/484,805

(22) Filed: Apr. 11, 2017

Related U.S. Application Data

(60) Provisional application No. 62/322,355, filed on Apr. 14, 2016.

(51) Int. Cl.
*E05B 63/12* (2006.01)
*E05B 47/06* (2006.01)
(Continued)

(52) U.S. Cl.
CPC ..... *E05B 63/128* (2013.01); *E05B 47/0603* (2013.01); *E05B 63/127* (2013.01);
(Continued)

(58) Field of Classification Search
CPC .. E05B 63/128; E05B 47/0603; E05B 63/127; E05B 77/34; E05B 81/14; E05B 81/18; E05B 85/04; E05B 85/22; E05B 15/0205; E05B 9/002; E05B 17/203; E05B 63/12; E05B 65/08; E05B 65/0811;
(Continued)

(56) References Cited

U.S. PATENT DOCUMENTS 115,231 A * 5/1871 Obernesser ..... E05B 63/12 70/122
973,301 A * 10/1910 Purdham ..... E05B 65/0811 70/99

(Continued)

*Primary Examiner* — Kristina R Fulton
*Assistant Examiner* — Faria F Ahmad
(74) *Attorney, Agent, or Firm* — Young Basile Hanlon & MacFarlane, P.C.

(57) ABSTRACT

A vehicle includes a vehicle body that defines an opening, a vehicle door that is movable between a closed position and an open position with respect to the opening, a first surface, and a second surface. The first surface is defined on one of the vehicle body and the door and the second surface is defined on the other of the vehicle body and the door. A first latch portion is concealed behind the first surface. A second latch portion is concealed behind the second surface in an unlatched position and is movable to a latched position in which the second latch portion extends into the first latch portion and engages the first latch portion. A locking structure restrains disengagement of the second latch portion from the first latch portion in the latched position.

21 Claims, 7 Drawing Sheets

(51) Int. Cl.

| | |
|---|---|
| ***E05B 85/22*** | (2014.01) |
| ***E05B 85/04*** | (2014.01) |
| ***E05B 77/34*** | (2014.01) |
| ***E05B 81/14*** | (2014.01) |
| ***E05B 81/18*** | (2014.01) |
| ***E05B 17/20*** | (2006.01) |
| ***E05B 15/02*** | (2006.01) |
| ***E05B 83/24*** | (2014.01) |
| ***E05B 9/00*** | (2006.01) |
| ***E05B 65/08*** | (2006.01) |
| ***E05C 3/02*** | (2006.01) |
| ***E05C 1/02*** | (2006.01) |

(52) U.S. Cl.
CPC ..... *E05B 77/34* (2013.01); *E05B 81/14* (2013.01); *E05B 81/18* (2013.01); *E05B 85/04* (2013.01); *E05B 85/22* (2013.01); *E05B 9/002* (2013.01); *E05B 15/0205* (2013.01); *E05B 17/203* (2013.01); *E05B 65/08* (2013.01); *E05B 65/0811* (2013.01); *E05B 65/0858* (2013.01); *E05B 83/243* (2013.01); *E05C 1/02* (2013.01); *E05C 3/02* (2013.01); *Y10T 292/096* (2015.04); *Y10T 292/1039* (2015.04); *Y10T 292/1043* (2015.04); *Y10T 292/1063* (2015.04); *Y10T 292/1064* (2015.04); *Y10T 292/1071* (2015.04); *Y10T 292/1075* (2015.04); *Y10T 292/694* (2015.04); *Y10T 292/696* (2015.04)

(58) Field of Classification Search
CPC ..... E05C 3/02; E05C 1/02; Y10T 292/1043; Y10T 292/1075; Y10T 292/1063; Y10T 292/1064; Y10T 292/1071; Y10T 292/1039; Y10T 292/694; Y10T 292/696; Y10T 29/096
See application file for complete search history.

(56) References Cited

U.S. PATENT DOCUMENTS 1,083,173 A * 12/1913 Zeckhauser ..... E05B 65/007 292/5
1,143,653 A * 6/1915 Smith ..... E05B 65/0811 70/97
1,193,653 A * 8/1916 Winn et al. ..... E05B 17/2003 292/346
1,278,561 A * 9/1918 Augenbraun ..... E05B 63/127 70/116
1,284,540 A * 11/1918 Yukanis ..... E05B 65/0811 70/97
1,377,658 A * 5/1921 Bock ..... E05B 63/127 70/131
1,398,636 A * 11/1921 Forlander ..... E05B 63/242 70/131
1,410,581 A * 3/1922 Langer ..... E05B 63/12 70/106
1,413,137 A * 4/1922 Sheinman ..... E05B 63/127 70/131
1,440,782 A * 1/1923 Kemp ..... E05B 63/12 70/103
1,493,526 A * 5/1924 Freysinger ..... E05B 63/128 70/118
1,533,629 A * 4/1925 Best ..... E05B 63/127 70/82
1,673,468 A * 6/1928 Palinkas ..... E05B 63/126 70/120
1,714,857 A * 5/1929 Dowling ..... E05B 63/127 70/116
1,810,760 A * 6/1931 Friedman ..... E05B 63/12 70/121
1,812,908 A 7/1931 Toncray et al.
1,893,450 A 1/1933 Shively
1,964,157 A * 6/1934 Holtzman ..... E05B 63/126 70/131
2,027,724 A 1/1936 Etzel
2,042,024 A * 5/1936 Schlage ..... E05B 15/0205 292/341.18
2,153,102 A 4/1939 Smith
2,446,113 A * 7/1948 Spiller ..... E05B 63/248 292/30
2,603,823 A 7/1952 Rossell
2,769,503 A 11/1956 Wagner
3,175,376 A * 3/1965 Cantwell ..... E05B 17/042 70/131
3,178,213 A * 4/1965 Nelson ..... E05C 19/02 292/18
3,600,021 A * 8/1971 Hawkins ..... E05B 63/128 292/167
3,636,745 A 1/1972 Green
3,702,549 A * 11/1972 Solovieff ..... E05B 15/0086 70/134
3,708,032 A * 1/1973 Suzuki ..... B60R 25/02142 180/287
4,087,121 A * 5/1978 Davis ..... E05B 63/128 292/139
4,208,837 A * 6/1980 Black, Sr. ..... E05B 65/1033 292/216
4,263,747 A * 4/1981 Coltrin ..... E05B 65/1033 292/38
4,453,752 A * 6/1984 McKann ..... E05B 15/024 292/341
4,493,500 A * 1/1985 Stroup ..... E05C 17/365 292/262
4,566,725 A * 1/1986 Klein ..... E05B 63/127 292/191
4,615,550 A * 10/1986 Abate ..... E05B 63/127 292/192
4,799,718 A * 1/1989 Ing ..... E05B 63/127 292/36
4,897,961 A * 2/1990 Shine ..... E05B 63/127 49/141
5,009,089 A * 4/1991 Lin ..... E05B 63/126 292/49
5,083,969 A 1/1992 Wagener
5,174,063 A * 12/1992 Lewis ..... E05B 65/1033 49/141
5,653,483 A * 8/1997 Grover ..... E05B 63/0052 292/194
6,082,790 A * 7/2000 Mossotti ..... E05B 17/005 292/1
6,557,475 B1 * 5/2003 Nygren ..... F42B 15/36 102/377
6,663,147 B1 * 12/2003 Alban ..... E05C 9/1841 292/27
7,836,737 B2 * 11/2010 Lin ..... E05B 63/127 292/159
2002/0195824 A1 * 12/2002 Fountaine ..... E05B 65/0811 292/11
2014/0060127 A1 * 3/2014 Hemmingsen ..... E05B 65/00 70/120
2015/0233144 A1 * 8/2015 Puscas ..... E05B 15/029 292/341.14
2016/0369538 A1 * 12/2016 Ledford ..... E05B 17/203
2019/0178014 A1 * 6/2019 Gerasimov ..... E05B 47/026
2019/0226233 A1 * 7/2019 Yalamati ..... E05B 9/002
2019/0226238 A1 * 7/2019 Sullivan ..... E05B 9/02

* cited by examiner

CONCEALED LATCH

CROSS-REFERENCE TO RELATED APPLICATIONS

This application claims the benefit of U.S. Provisional Application No. 62/322,355, filed on Apr. 14, 2016, which is incorporated herein by reference in its entirety.

TECHNICAL FIELD

The application relates generally to latches for securing vehicle doors.

BACKGROUND

Vehicles incorporate portions that open and close, which are referred to herein generally as doors. As examples, vehicles may include side passenger doors, sliding doors, a hatch door, a tailgate, a hood, and a fuel door cover. To secure doors in their closed positions, vehicle doors typically include a latch that is designed to prevent unintended opening of the door. As an example, latches for vehicle doors are typically designed to resist opening as a result of forces exerted upon the latch during an impact.

A common design for vehicle door latches includes a striker and a jaw that are each attached to one of a vehicle door or a vehicle body. The striker is a heavy gauge wire that is bent in to a shape that spaces part of the wire from the vehicle body. For example, a u-shaped configuration is common. The jaw is configured to open if it contacts the striker, and subsequently close to capture the striker. The jaw can then be opened by a user to release the striker, for example, using a door handle that is located on the door of the vehicle. This design is reliable and generates a significant holding force to restrain inadvertent opening of the door. However, this design also includes exposed mechanical parts that protrude from the body of the vehicle and are visually unappealing.

SUMMARY

One aspect of the disclosure is a vehicle that includes a vehicle body that defines an opening, a vehicle door that is movable between a closed position and an open position with respect to the opening, a first surface, and a second surface. The first surface is defined on one of the vehicle body and the door and the second surface is defined on the other of the vehicle body and the door. A first latch portion is concealed behind the first surface. A second latch portion is concealed behind the second surface in an unlatched position and is movable to a latched position in which the second latch portion extends into the first latch portion and engages the first latch portion. A locking structure restrains disengagement of the second latch portion from the first latch portion in the latched position.

Another aspect of the disclosed embodiments is a latch that includes a first surface having a first aperture, a second surface having a second aperture, a first latch part that is located behind the first surface, and a second latch part that is movable between an unlatched position and a latched position with respect to the first latch part. The second latch part is located behind the second surface in the unlatched position, and the second latch part extends through the first and second apertures into the first latch part to secure the first latch part with respect to the second latch part in the latched position. A first cover occupies the first aperture when the second latch part is in the unlatched position, and is flush with the first surface when the second latch part is in the unlatched position. A second cover occupies the second aperture when the second latch part is in the unlatched position, and is flush with the second surface when the second latch part is in the unlatched position.

Another aspect of the disclosed embodiments is a vehicle that includes a vehicle body that includes a vehicle body portion and a door that is connected to the vehicle body portion by a hinge for movement between a closed position and an open position. A first latch part that is concealed behind a first surface of the vehicle body, and the first surface has a first aperture formed through it. A second latch part is concealed behind a second surface of the vehicle body in an unlatched position. The second surface has a second aperture formed through it. The second latch part extends through the second aperture and the first aperture into the first latch part in a latched position. A first cover occupies the first aperture in the unlatched position. A second cover that occupies the second aperture in the latched position.

DETAILED DESCRIPTION

The following disclosure relates generally to latches for doors and is applicable, for example, to vehicle doors. In structures where a first surface is to be latched to a second surface, latch parts may be recessed within the structures behind the respective surfaces to avoid interrupting the surfaces with mechanical components that may interfere with aesthetics and usability. This may be done by defining apertures in the surfaces and recessing the components behind the apertures, with end portions or covers being positioned in the apertures in an unlatched position in a manner that is complementary to the surfaces. One of the latch parts may extend through the apertures to connect the latch parts in a latched position. Locking components may be provided to restrain unintentional separation of the latch parts.

Figure 1:
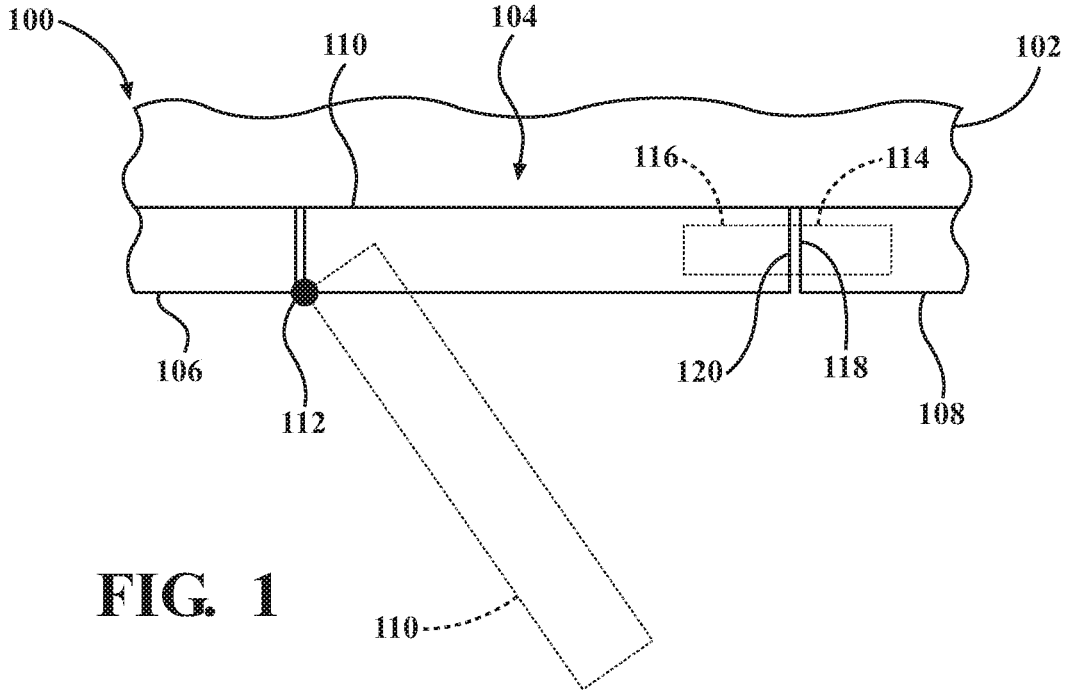
FIG. 1 is a top view illustration showing a portion of a vehicle according to a first example.

FIG. 1 shows a portion of a vehicle 100 according to a first example. The vehicle 100 can be a passenger vehicle that is configured for operation on public roads.

The vehicle 100 includes a vehicle body 102. An opening 104 is defined between a first body portion 106 of the vehicle body 102 and a second body portion 108 of the vehicle body 102. A door 110 is connected to the first body portion 106 by a hinge 112. The door 110 is positionable in the opening 104 and is movable between a closed position and an open position (depicted with broken lines). When the door 110 is in the closed position, the door 110 occupies the opening 104 and restricts movement of persons and/or objects into and out of the vehicle 100 through the opening 104. When the door 110 is in the closed position, at least part of the door 110 has been moved out of the opening, such as by pivoting or translating, and the opening 104 is usable for moving persons and/or objects into and out of the vehicle 100 through the opening 104. The door 110 may move with respect to the vehicle body 102 by rotating with respect to the vehicle body 102 on a hinge axis of the hinge 112. As one example, the door 110 may be a side door for the vehicle 100 to allow passenger ingress and egress. As another example, the door 110 may be a door that allows access to a cargo area of the vehicle 100, such as a hatch door. The door 110 may alternatively be any other type of door of the vehicle 100.

The vehicle 100 includes a latch assembly that has a first latch part 114 and a second latch part 116. In the illustrated example, the first latch part 114 is connected to and located in the second body portion 108, and the second latch part 116 is connected to and located in the door 110. The first latch part 114 is located on or adjacent to a first surface 118 that is defined on the second body portion 108 of the vehicle 100. The second latch part 116 is located on or adjacent to a second surface 120 that is defined on the door 110. When the door 110 is in the closed position, the first surface 118 faces the second surface 120. The first and second surfaces 118, 120 extend in a direction that is generally tangential to the axis of the hinge 112.

The first latch part 114 and the second latch part 116 are movable between an unlatched position and a latched position. At least a portion of the first latch part 114 or the second latch part 116 moves in a direction that is generally radial relative to the axis of the hinge 112.

In the unlatched position, the door 110 is movable with respect to the second body portion 108. The first latch part 114 and the second latch part 116 are recessed within the second body portion 108 and the door 110 in the unlatched position. Recessing the first latch part 114 and the second latch part 116 relative to the first and second surfaces 118, 120 respectively may mean that the first surface 118 and the second surface 120 are not interrupted by the first latch part 114 and the second latch part 116. As an example, exposed portions of the first and second latch parts 114, 116 may be flush with the first and second surfaces 118, 120, while other portions of the first and second latch parts 114, 116 are concealed.

In the latched position, the first and second latch parts 114, 116 interact to restrain the door 110 from moving from the closed position to the open position. For example, part of one of the first latch part 114 or the second latch part 116 may extend across a gap between the first and second surfaces 118, 120, and extend into the opposed one of the first and second surfaces 118, 120 and into engagement with part of the other of the first latch part 114 and the second latch part 116.

Figure 2:
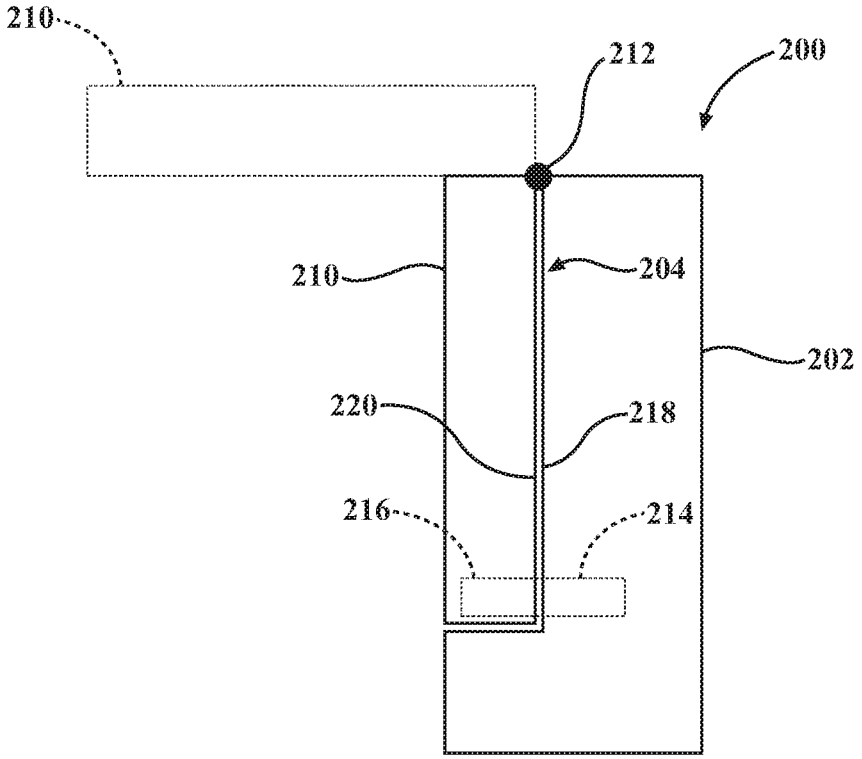
FIG. 2 is a side view illustration showing a portion of a vehicle according to a second example.

FIG. 2 shows a portion of a vehicle 200 according to a second example. The vehicle 200 includes a vehicle body 202. An opening 204 is defined by the vehicle body 202. A door 210 is connected to the vehicle body 202 by a hinge 212. The door 210 is positionable in the opening 204 and is movable between a closed position and an open position (depicted with broken lines). The door 210 may move with respect to the vehicle body 202 by rotating with respect to the vehicle body 202 on a hinge axis of the hinge 212. As an example, the door 210 may be a rear hatch door for the vehicle 200 to allow access to a cargo area that is locate inside the vehicle body 202. The door 210 may alternatively be any other type of door of the vehicle 200.

The vehicle 200 includes a latch assembly that has a first latch part 214 and a second latch part 216. In the illustrated example, the first latch part 214 is connected to and located in the vehicle body 202, and the second latch part 216 is connected to and located in the door 210. The first latch part 214 is located on or adjacent to a first surface 218 that is defined on the vehicle body 202 of the vehicle 200. The second latch part 216 is located on or adjacent to a second surface 220 that is defined on the door 210. When the door 210 is in the closed position, the first surface 218 faces the second surface 220. The first and second surfaces 218, 220 extend in a direction that is generally radial with respect to the axis of the hinge 212.

The first latch part 214 and the second latch part 216 are movable between an unlatched position and a latched position. At least a portion of the first latch part 214 or the second latch part 216 moves in a direction that is generally tangential to the axis of the hinge 212.

In the unlatched position, the door 210 is movable with respect to the vehicle body 202, and first latch part 214 and the second latch part 216 are recessed within the vehicle body 202 and the door 210. Recessing the first latch part 214 and the second latch part 216 relative to the first and second surfaces 218, 220 respectively may mean that the first surface 218 and the second surface 220 are not interrupted by the first latch part 214 and the second latch part 216. As an example, exposed portions of the first and second latch parts 214, 216 may be flush with the first and second surfaces 218, 220, while other portions of the first and second latch parts 114, 116 are concealed behind the first and second surfaces 218, 220.

In the latched position, the first and second latch parts 214, 216 interact to restrain the door 210 from moving from the closed position to the open position. For example, part of one of the first latch part 214 or the second latch part 216 may extend across a gap between the first and second surfaces 218, 220, and extend into the opposed one of the first and second surfaces 218, 220 and into engagement with part of the other of the first latch part 214 and the second latch part 216.

The implementations shown in FIGS. 1-2 are examples of structures that latch assemblies can be used with. The latch assemblies described herein can be used with other types of structures, in order to secure two relatively movable components. In addition, relatively movable structures may be rotatable as in the previous examples, or may translate with respect to each other, or may move relative to one another by a combination of rotation and translation. As an example, the latches described herein may also be used with sliding doors, or with doors that are supported by a linkage motion system.

Figure 3:
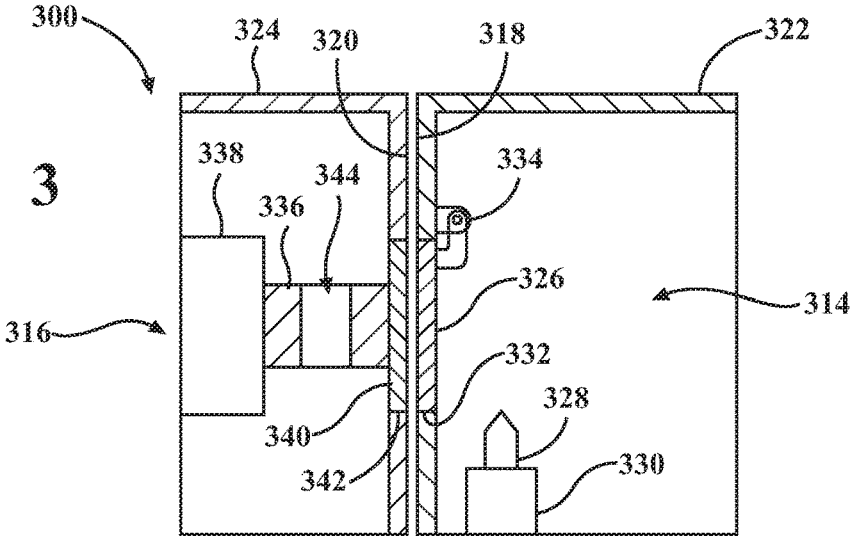
FIG. 3 is a cross-section view showing a latch assembly according to a first example in an unlatched position.
Figure 4:
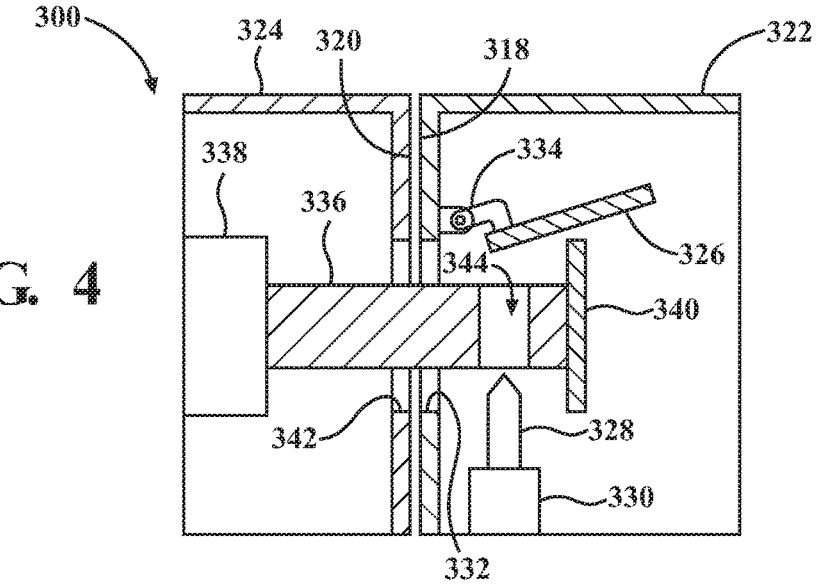
FIG. 4 is a cross-section view showing the latch assembly according to the first example in an intermediate position.
Figure 5:
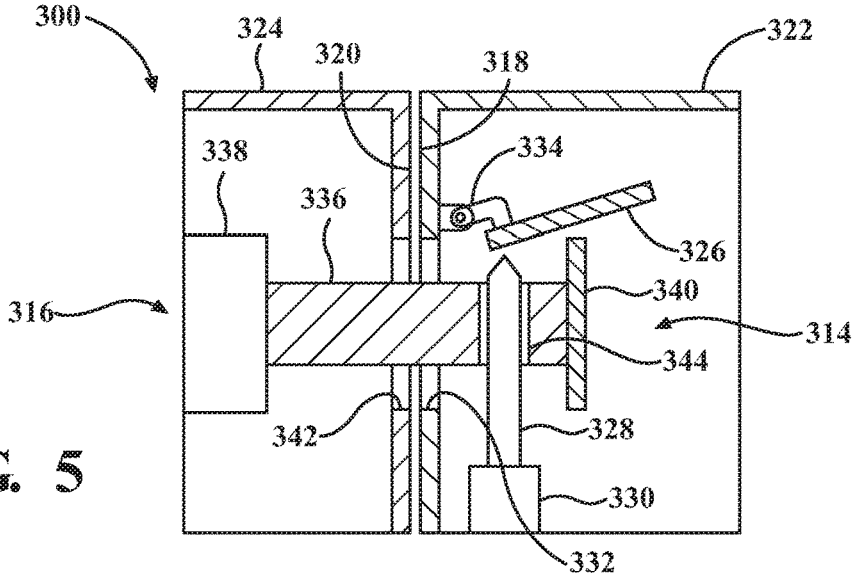
FIG. 5 is a cross-section view showing the latch assembly according to the first example in a latched position.

FIGS. 3-5 show a latch assembly 300 according to a first example. The latch assembly 300 includes a first latch part 314 that is connected to a first structure 322 and a second latch part 316 that is connected to a second structure 324. The first structure 322 and the second structure 324 may be connected by a hinge, as described with respect to the vehicle 100 and the vehicle 200. As one example, the first structure 322 may be a vehicle body and the second structure 324 may be a vehicle door. As another example, the first structure 322 may be a vehicle door and the second structure 324 may be a vehicle body.

The first structure 322 includes a first surface 318, and the second structure 324 includes a second surface 320. The first and second structures 322, 324 are movable between a closed position, in which the first and second surfaces 318, 320 are positioned opposite one another and are adjacent to one another, and an open position, in which the first and second surfaces 318, 320 are spaced from each other to define an opening between the first and second structures 322, 324 through which people and/or objects may pass.

The first latch part 314 includes a cover 326, a lock pin 328, and a pin actuator 330. The cover 326 is disposed in an aperture 332 that is formed through the first surface 318. The cover 326 is moveable into and out of the aperture 332. As examples, the cover 326 may be connected to the first structure 322 by a hinge 334 that is spring-biases the cover 326 into the aperture 332, the cover 326 may be connected to the first structure 322 by a spring biased linear slide (not shown), the cover 326 may be connected to the first structure 322 by an actuator such as a rotary actuator or a linear actuator, or the cover 326 may be connected to the first structure 322 by any other structure or devices that is operable to permit and/or cause movement of the cover 326 with respect to the aperture 332. The lock pin 328 is a locking structure that is operable to engage a portion of the second latch part 316 to restrain disengagement of the second latch part 316 from the first latch part 314 when in the latched position, as will be described herein. The pin actuator 330 is operable to move the lock pin 328 into and out of engagement with the second latch part 316 by moving between a retracted position and an extended position. The pin actuator 330 may be any type of device that is operable to cause motion of the lock pin 328, and can be controlled by signals provided from an electronic control system using an electrical connection.

The cover 326 may have a shape that corresponds to the shape of the aperture 332. For example, a peripheral shape of the cover 326 may be complementary to the shape of the interior periphery of the aperture 332. As examples, the peripheral shape of the cover 326 and the shape of the interior periphery of the aperture 332 may both be circular, elliptical, square, rectangular, or any other shape. The relative sizes of the cover 326 and the aperture 332 may be selected such that a minimal gap is present between the cover 326 and the aperture 332 when the cover 326 occupies the aperture. Thus, when the cover 326 is present in the aperture 332, only the minimal gap between the components would be visible on the first surface 318, and all portions of the first latch part 314 would be recessed and concealed within the first structure 322 except for the cover 326. The exposed surface of the cover 326 may have a geometry that matches the geometry of the first surface 318, such that it is flush with respect to the first surface 318, leaving the first surface 318 generally free from interruptions.

The second latch part 316 includes a bolt 336 and a bolt actuator 338. The bolt 336 may be an elongate structure that extends along a bolt axis. In the illustrated example, the bolt 336 is generally cylindrical, but other geometries may be used. The bolt 336 is movable between recessed and extended positions with respect to the second structure 324, in order to cross the gap between the first and second structures 322, 324 to engage the first latch part 314 and secure the second structure 324 with respect to the first structure 322. The bolt actuator 338 is operable to move the bolt 336 along the bolt axis between the recessed and extended positions to cause engagement of the bolt 336 with respect the bolt actuator 338. The bolt actuator 338 may be any type of device that is operable to cause movement of the bolt 336, such as a solenoid or a linear actuator, and can be controlled by signals provided from an electronic control system using an electrical connection.

The bolt 336 includes a cover portion 340 that functions similar to the cover 326 of the first latch part 314. The cover portion 340 maybe an end portion of the bolt 336 that is fixed relative the bolt 336, and may be formed integrally with or separately from the bolt 336. Alternatively, the cover portion 340 may be independent of the bolt 336, such as by being movably connected to the second structure 324. The cover portion 340 is disposed in an aperture 342 that is formed through the second surface 320. The cover portion 340 is moveable into and out of the aperture 342. In particular, the cover portion 340 may move in unison with the bolt 336 such that the cover portion 340 occupies the aperture 342 when the bolt 336 is in the recessed position relative to the second structure 324 and such that the end portion is moved away from the aperture 342 when the bolt 336 is in the extended position. In an alternative in which the cover portion 340 is independent of the bolt 336, the cover portion 340 may be moveable, such as by an actuator, into and out of the aperture 342 to allow movement of the bolt 336 from the recessed position to the extended position.

The cover portion 340 may have a shape that corresponds to the shape of the aperture 342. For example, a peripheral shape of the cover portion 340 may be complementary to the shape of the interior periphery of the aperture 342. As examples, the peripheral shape of the cover portion 340 and the shape of the interior periphery of the aperture 342 may both be circular, elliptical, square, rectangular, or any other shape. The relative sizes of the cover portion 340 and the aperture 342 may be selected such that a minimal gap is present between the cover portion 340 and the aperture 342 when the cover portion 340 occupies the aperture. Thus, when the cover portion 340 is present in the aperture 342, only the minimal gap between the components would be visible on the second surface 320, and all portions of the second latch part 316 would be recessed and concealed within the second structure 324 except for the cover portion 340. The exposed surface of the cover portion 340 may have a geometry that matches the geometry of the second surface 320, such that it is flush with respect to the second surface 320, leaving the second surface 320 generally free from interruptions.

In order to secure the second latch part 316 with respect to the first latch part 314, a lock aperture 344 is formed through the bolt 336. The lock aperture 344 is sized, configured, and oriented such that the lock pin 328 may extend into the lock aperture 344 when the second latch part 316 is extended into the first latch part 314. The orientation of the lock aperture 344 may be selected to allow interaction with the lock pin 328, and motion of the lock pin 328 by the pin actuator 330 may be in the same direction as the direction along which the lock aperture 344 extends. As an example, the lock aperture 344 may extend transverse to the bolt axis, in which case motion of the lock pin 328 by the pin actuator 330 may be transverse to the bolt axis.

The latch assembly 300 may be moved between an unlatched position (FIG. 3) and a latched position (FIG. 3). To move the latch assembly 300 from the unlatched position the first and second structures 322, 324 are positioned adjacent to each other, such as in the closed position, with the first surface 318 facing the second surface 320 and the cover 326 in alignment with the cover portion 340, the bolt 336, and the bolt axis.

First, the bolt actuator 338 moves the bolt 336 along the bolt axis. The cover 326 is then caused to move from the aperture 332 to a position in which it is not obstructing the aperture 332. In the illustrated example, contact of the cover portion 340 with the cover 326 causes the cover 326 to rotate into the first structure 322 and out of the path of the bolt 336. The bolt 336 is moved from the recessed position to the extended position along the bolt axis by the bolt actuator 338, and the bolt 336 passes through the aperture 342 in the second surface 320 and the aperture 332 in the first surface 318 before reaching an intermediate position (FIG. 4). In the intermediate position, the lock aperture 344 of the bolt 336 is aligned with the lock pin 328. The lock pin 328 is moved from the retracted position to the extended position by the pin actuator 330. In the extended position, the lock pin 328 extends into the lock aperture 344. Engagement of the lock pin 328 with the bolt 336 restrains retraction of the bolt 336 from the first structure 322. Movement of the latch assembly 300 from the latched position to the unlatched position is performed in the same manner by reversing the operations.

Figure 6:
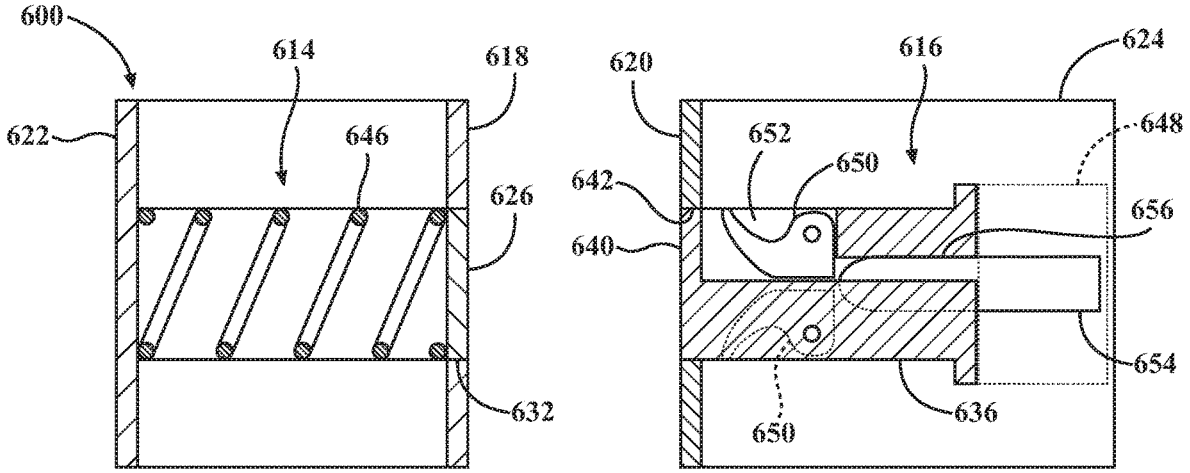
FIG. 6 is a cross-section view showing a latch assembly according to a second example in an unlatched position.
Figure 7:
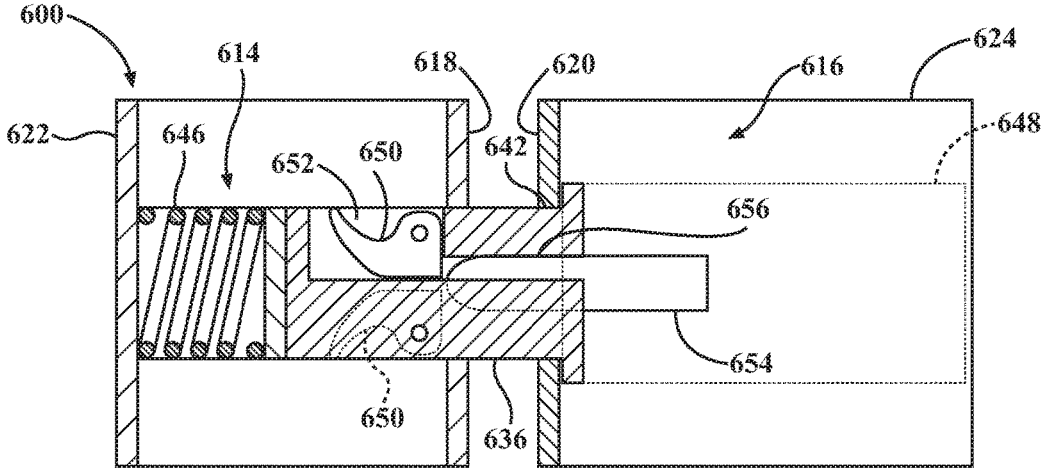
FIG. 7 is a cross-section view showing the latch assembly according to the second example in an intermediate position.
Figure 8:
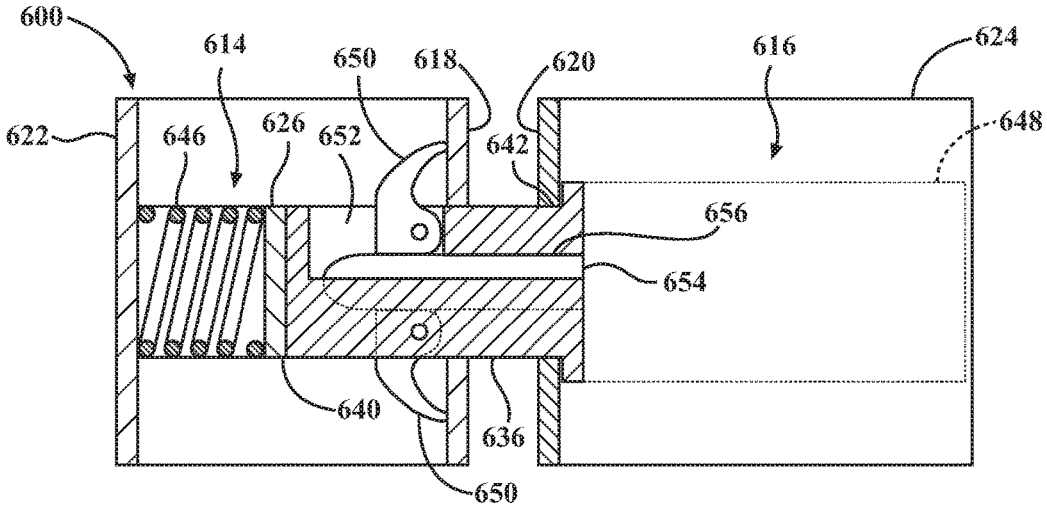
FIG. 8 is a cross-section view showing the latch assembly according to the second example in a latched position.
Figure 9:
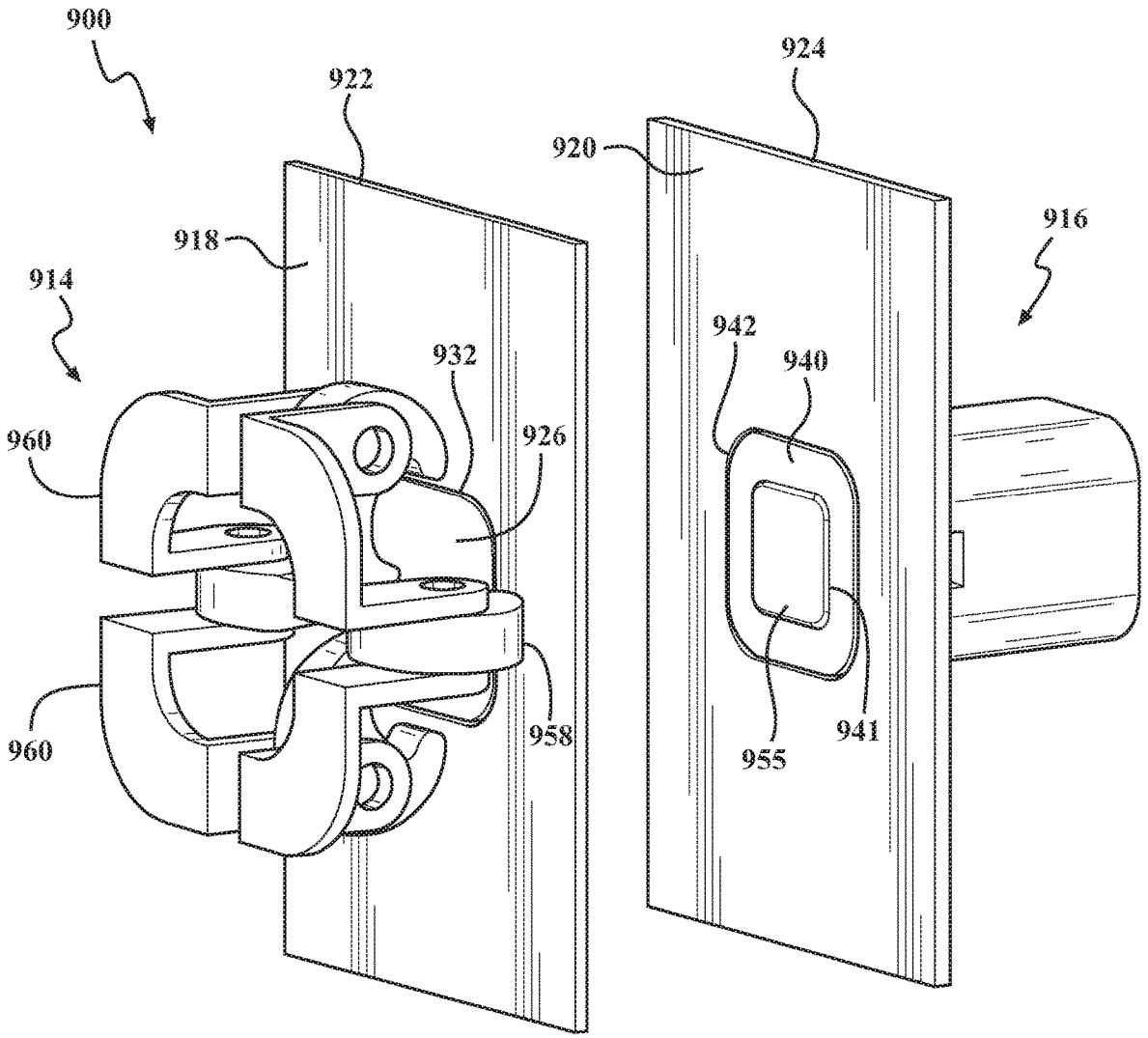
FIG. 9 is a perspective view showing a latch assembly according to a third example in an unlatched position.
Figure 10:
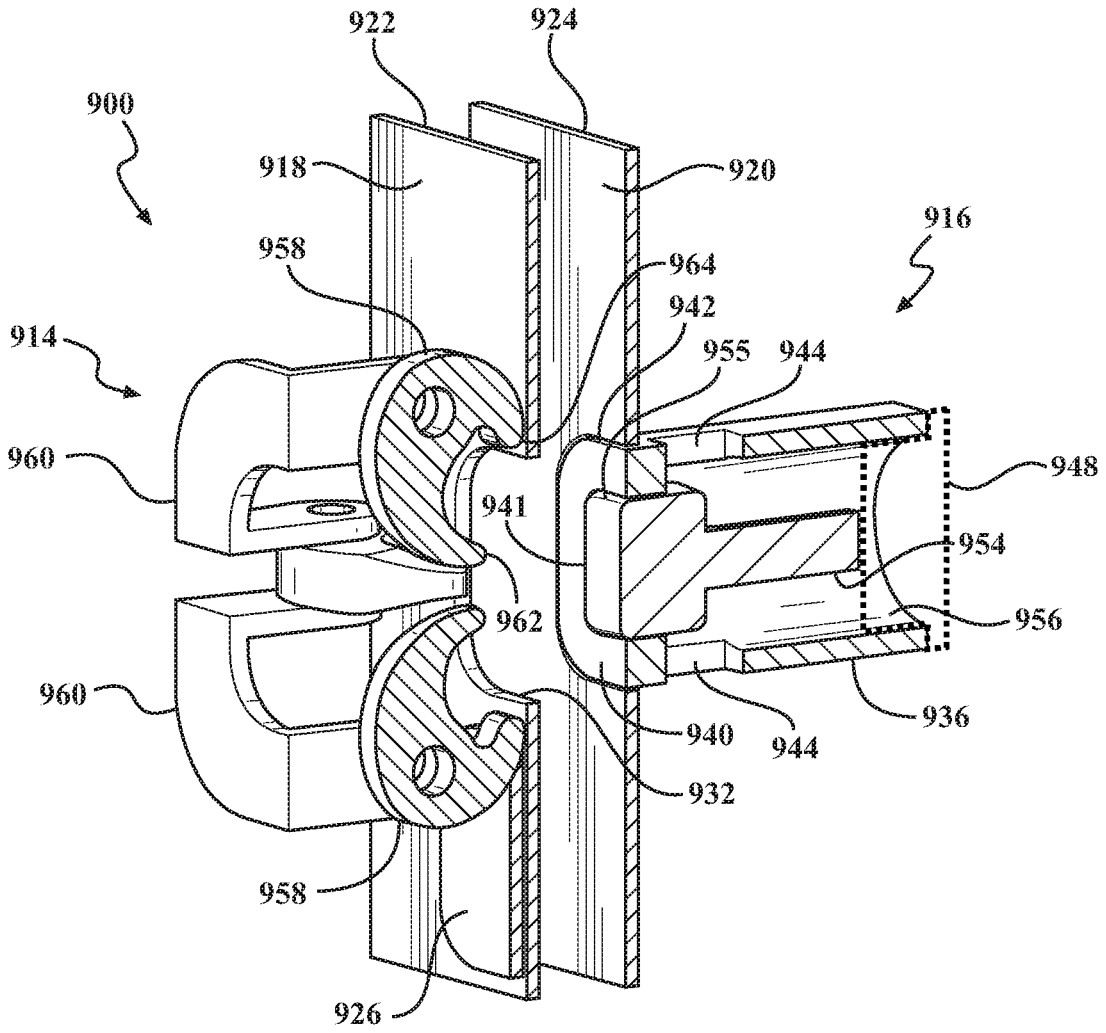
FIG. 10 is a cross-section perspective view showing the latch assembly according to the third example in the unlatched position.

FIGS. 6-8 show a latch assembly 600 according to a second example. The latch assembly 600 includes a first latch part 614 that is connected to a first structure 622 and a second latch part 616 that is connected to a second structure 624. The first structure 622 and the second structure 624 may be connected by a hinge, as described with respect to the vehicle 100 and the vehicle 200. As one example, the first structure 622 may be a vehicle body and the second structure 624 may be a vehicle door. As another example, the first structure 622 may be a vehicle door and the second structure 624 may be a vehicle body.

The first structure 622 includes a first surface 618, and the second structure 624 includes a second surface 620. The first and second structures 622, 624 are movable between a closed position, in which the first and second surfaces 618, 620 are positioned opposite one another and are adjacent to one another, and an open position, in which the first and second surfaces 618, 620 are spaced from each other to define an opening between the first and second structures 622,624 through which people and/or objects may pass.

The first latch part 614 includes a cover 626. The cover 626 is disposed in an aperture 632 that is formed through the first surface 618. The cover 626 is moveable into and out of the aperture 632. In the illustrated example, the cover 626 is connected to a compression spring 646 that urges the cover 626 into the aperture 632. As other examples, the cover 626 may be connected to the first structure 622 by a hinge that is spring-biases the cover 626 into the aperture 632, the cover 626 may be connected to the first structure 622 by a spring biased linear slide (not shown), the cover 626 may be connected to the first structure 622 by an actuator such as a rotary actuator or a linear actuator, or the cover 626 may be connected to the first structure 622 by any other structure or devices that is operable to permit and/or cause movement of the cover 626 with respect to the aperture 632.

The cover 626 may have a shape that corresponds to the shape of the aperture 632. For example, a peripheral shape of the cover 626 may be complementary to the shape of the interior periphery of the aperture 632. As examples, the peripheral shape of the cover 626 and the shape of the interior periphery of the aperture 632 may both be circular, elliptical, square, rectangular, or any other shape. The relative sizes of the cover 626 and the aperture 632 may be selected such that a minimal gap is present between the cover 626 and the aperture 632 when the cover 626 occupies the aperture. Thus, when the cover 626 is present in the aperture 632, only the minimal gap between the components would be visible on the first surface 618, and all portions of the first latch part 614 would be recessed and concealed within the first structure 622 except for the cover 626. The exposed surface of the cover 626 may have a geometry that matches the geometry of the first surface 618, such that it is flush with respect to the first surface 618, leaving the first surface 618 generally free from interruptions.

The second latch part 616 includes a bolt 636 and an actuator assembly 648. The bolt 636 may be an elongate structure that extends along a bolt axis. In the illustrated example, the bolt 636 is generally cylindrical, but other geometries may be used. The bolt 636 is movable between recessed and extended positions with respect to the second structure 624, in order to cross the gap between the first and second structures 622, 624 to engage the first latch part 614 and secure the second structure 624 with respect to the first structure 622.

The bolt 636 includes a cover portion 640 that functions similar to the cover 626 of the first latch part 614. In the illustrated example, the cover portion 640 is an integrally formed end portion of the bolt 636 that is fixed relative the bolt 636. In alternative implementations, the cover portion 640 may be formed separately from the bolt 636 and fixed to the bolt 636 by suitable fasteners or methods. Alternatively, the cover portion 640 may be independent of the bolt 636, such as by being movably connected to the second structure 624. The cover portion 640 is disposed in an aperture 642 that is formed through the second surface 620. The cover portion 640 is moveable into and out of the aperture 642. In particular, the cover portion 640 may move in unison with the bolt 636 such that the cover portion 640 occupies the aperture 642 when the bolt 636 is in the recessed position relative to the second structure 624 and such that the end portion is moved away from the aperture 642 when the bolt 636 is in the extended position. In an alternative in which the cover portion 640 is independent of the bolt 636, the cover portion 640 may be moveable, such as by an actuator, into and out of the aperture 642 to allow movement of the bolt 636 from the recessed position to the extended position.

The cover portion 640 may have a shape that corresponds to the shape of the aperture 642. For example, a peripheral shape of the cover portion 640 may be complementary to the shape of the interior periphery of the aperture 642. As examples, the peripheral shape of the cover portion 640 and the shape of the interior periphery of the aperture 642 may both be circular, elliptical, square, rectangular, or any other shape. The relative sizes of the cover portion 640 and the aperture 642 may be selected such that a minimal gap is present between the cover portion 640 and the aperture 642 when the cover portion 640 occupies the aperture. Thus, when the cover portion 640 is present in the aperture 642, only the minimal gap between the components would be visible on the second surface 620, and all portions of the second latch part 616 would be recessed and concealed within the second structure 624 except for the cover portion 640. The exposed surface of the cover portion 640 may have a geometry that matches the geometry of the second surface 620, such that it is flush with respect to the second surface 620, leaving the second surface 620 generally free from interruptions.

The bolt 636 also includes locking members 650, which serve as a locking structure to restrain disengagement of the second latch part 616 from the first latch part 614 when in the latched position. The locking members 650 are each pivotally connected to the bolt 636 to rotate between retracted and extended positions around respective axes that are generally tangential to the bolt axis. The locking members 650 may be disposed in slots 652 that are formed in the bolt 636 and extend longitudinally along the bolt 636. In the illustrated example, the locking members 650 have a claw-like configuration. Other geometries may be used for the locking members 650.

When moved to the extended position, the locking members 650 extend outward relative to a nominal exterior profile of the bolt 636, which may be complementary to the aperture 632 and the aperture 642. Thus, when the bolt 636 is extended into the first latch part 614 and the first structure 622, the bolt 636 may be restrained from retracting from the first latch part 614 and the first structure 622 because the locking members 650 will be unable to pass through the aperture 632 when extended, because of engagement of the locking members 650 with an internal portion of the first latch part 614 and/or the first structure 622.

The locking members 650 may be extended and retracted by an actuator rod 654 that is disposed in a passage 656 that is formed in the bolt 636 and extends in the direction of the bolt axis. Extension of the actuator rod 654 along the passage 656 toward the cover portion 640 causes the actuator rod 654 to engage the locking members 650. As the actuator rod 654 engages the locking members 650, the actuator rod 654 functions as a cam, and the locking members 650 function as cam followers, by rotating in response to engagement of the actuator rod 654. The geometry of the actuator rod and the locking members 650 may be configured to cause motion of the locking members 650 at timings, rates, and extents as desired. While the actuator rod 654 is extended, the locking members 650 are restrained from rotating back toward their retracted positions, which causes the locking members 650 to be locked in place and resist unintentional separation of the first and second latch parts 614, 616.

The actuator assembly 648 is operable to move the bolt 636 along the bolt axis between the recessed and extended positions to cause engagement of the bolt 636 with respect to the first latch part 614. The actuator assembly 648 may be any type of device that is operable to cause movement of the bolt 636, such as a solenoid or a linear actuator, and can be controlled by signals provided from an electronic control system using an electrical connection. The actuator assembly 648 is also operable to drive extension and retraction of the actuator rod 654. The actuator assembly 648 may drive motion of the bolt 636 and the actuator rod 654 independently, such as by using separate actuator motors, or the actuator assembly 648 may drive motion of the bolt 636 and the actuator rod 654 dependently, such as by a mechanical linkage that controls relative timing of the motion of the bolt 636 and the actuator rod 654 in response to operation of a single actuator motor.

The latch assembly 600 may be moved between an unlatched position (FIG. 6) and a latched position (FIG. 8). To move the latch assembly 600 from the unlatched position, the first and second structures 622, 624 are positioned adjacent to each other, such as in the closed position, with the first surface 618 facing the second surface 620 and with the cover 626 in alignment with the cover portion 640, the bolt 636, and the bolt axis.

First, the actuator assembly 648 moves the bolt 636 along the bolt axis. The cover 626 is then caused to move from the aperture 632 to a position in which it is not obstructing the aperture 632. In the illustrated example, contact of the cover portion 640 with the cover 626 causes the cover 626 to retract linearly into the first structure 622 against the force exerted by the compression spring 646. The bolt 636 is moved from the recessed position to the extended position along the bolt axis by the actuator assembly 648, and the bolt 636 passes through the aperture 642 in the second surface 620 and the aperture 632 in the first surface 618 before reaching an intermediate position (FIG. 7). While the bolt 636 is moving toward the intermediate position or after the bolt 636 reaches the intermediate position, the actuator assembly 648 causes extension of the actuator rod 654 which in turn causes extension of the locking members 650. When the locking members 650 reach their extended positions, they are locked in place by engagement with the actuator rod 654 while the actuator rod 654 remains in its extended position. Movement of the latch assembly 600 from the latched position to the unlatched position is performed in the same manner by reversing the operations.

FIGS. 9-12 show a latch assembly 900 according to a third example. The latch assembly 900 includes a first latch part 914 that is connected to a first structure 922 and a second latch part 916 that is connected to a second structure 924. The first structure 922 and the second structure 924 may be connected by a hinge, as described with respect to the vehicle 100 and the vehicle 200. As one example, the first structure 922 may be a vehicle body and the second structure 924 may be a vehicle door. As another example, the first structure 922 may be a vehicle door and the second structure 924 may be a vehicle body.

The first structure 922 includes a first surface 918, and the second structure 924 includes a second surface 920. The first and second structures 922, 924 are movable between a closed position, in which the first and second surfaces 918, 920 are positioned opposite one another and are adjacent to one another, and an open position, in which the first and second surfaces 918, 920 are spaced from each other to define an opening between the first and second structures 922,924 through which people and/or objects may pass.

The first latch part 914 includes a cover 926. The cover 926 is disposed in an aperture 932 that is formed through the first surface 918. The cover 926 is moveable into and out of the aperture 932. In the illustrated example, the cover 926 moves transverse to the aperture 932 between a position in which the cover 926 occupies the aperture 932 and a position in which the cover 926 does not occupy or obstruct the aperture 932. The first latch part 914 may include a cover actuator (not shown) to move the cover 926, which may be any type of actuator such as a linear actuator or a rotary actuator that is operable to move the cover 926 with respect to the first structure 922. As other examples, the cover 926 may be connected to the first structure 922 by a hinge that is spring-biases the cover 926 into the aperture 932, the cover 926 may be connected to the first structure 922 by a spring biased linear slide (not shown), or the cover 926 may be connected to the first structure 922 by any other structure or devices that is operable to permit and/or cause movement of the cover 926 with respect to the aperture 932.

The cover 926 may have a shape that corresponds to the shape of the aperture 932. For example, a peripheral shape of the cover 926 may be complementary to the shape of the interior periphery of the aperture 932. As examples, the peripheral shape of the cover 926 and the shape of the interior periphery of the aperture 932 may both be circular, elliptical, square, rectangular, or any other shape. The relative sizes of the cover 926 and the aperture 932 may be selected such that a minimal gap is present between the cover 926 and the aperture 932 when the cover 926 occupies the aperture. Thus, when the cover 926 is present in the aperture 932, only the minimal gap between the components would be visible on the first surface 918, and all portions of the first latch part 914 would be recessed and concealed within the first structure 922 except for the cover 926. The exposed surface of the cover 926 may have a geometry that matches the geometry of the first surface 918, such that it is flush with respect to the first surface 918, leaving the first surface 918 generally free from interruptions.

The first latch part 914 also includes locking members 958 that function as a locking structure that is engageable with a portion of the second latch part 916 to restrain retraction of the second latch part 916 from inside the first latch part 914 when the second latch part is extended and in the latched position. The locking members 958 are supported for rotation relative to the first structure 922 by mounting parts 960. The connection between the locking members 958 and the mounting parts 960 may be made by conventional structures such as any type of pivot joint. The mounting parts 960 are configured to support the locking members 958 such that they are arrayed radially around the second latch part 916 when it is extended into the first latch part 914. In the illustrated example, four locking members 958 are arrayed radially at 90 degree radial intervals, as if each were positioned on an adjacent side of a square. The locking members 958 each have a first end 962 that functions as a cam follower, and a second end 964 that functions as an engaging structure that resists motion of the second latch part 916 when engaged. The axis of rotation of each locking member 958 is, in the illustrated example, located between the first and second ends 962, 964. In the illustrated example, the locking members 958 are generally C-shaped, but other geometries may be used.

The second latch part 916 includes a bolt 936 and an actuator rod 954. The bolt 936 may be an elongate structure that extends along a bolt axis. In the illustrated example, the bolt 936 is generally cylindrical and tubular, with a passage 956 extending along the bolt axis, but other geometries may be used. The bolt 936 is movable between recessed and extended positions with respect to the second structure 924, in order to cross the gap between the first and second structures 922, 924 to engage the first latch part 914 and secure the second structure 924 with respect to the first structure 922. An actuator assembly 948 is operable to cause movement of the bolt 936 and/or the actuator rod 954.

The bolt 936 includes a cover portion 940 that functions similar to the cover 926 of the first latch part 914. In the illustrated example, the cover portion 940 is an integrally formed end surface of the bolt 936 that is fixed relative the bolt 936. In alternative implementations, the cover portion 940 may be formed separately from the bolt 936 and fixed to the bolt by suitable fasteners or methods. Alternatively, the cover portion 940 may be independent of the bolt 936, such as by being movably connected to the second structure 924. The cover portion 940 is disposed in an aperture 942 that is formed through the second surface 920. The cover portion 940 is moveable into and out of the aperture 942. In particular, the cover portion 940 may move in unison with the bolt 936 such that the cover portion 940 occupies the aperture 942 when the bolt 936 is in the recessed position relative to the second structure 924 and such that the end portion is moved away from the aperture 942 when the bolt 936 is in the extended position. In an alternative in which the cover portion 940 is independent of the bolt 936, the cover portion 940 may be moveable, such as by an actuator, into and out of the aperture 942 to allow movement of the bolt 936 from the recessed position to the extended position.

The bolt 936 also includes an actuator rod 954 that is disposed in the passage 956 and is moveable with respect to the bolt 936, such as in a direction along or parallel to the bolt axis, as will be explained. The actuator rod 954 has an end surface 955 that is disposed in an axial end opening 941 of the cover portion 940 when the bolt 936 is in the retracted position. The end surface 955 is configured to define a minimal gap with respect to the axial end opening 941 in the recessed position to partially occupy the aperture 942 along with the cover portion 940, by having a geometry similar to that of the cover portion 940 to remain generally flush relative to the second surface 920.

The cover portion 940 may have a shape that corresponds to the shape of the aperture 942. For example, a peripheral shape of the cover portion 940 may be complementary to the shape of the interior periphery of the aperture 942. As examples, the peripheral shape of the cover portion 940 and the shape of the interior periphery of the aperture 942 may both be circular, elliptical, square, rectangular, or any other shape. The relative sizes of the cover portion 940 and the aperture 942 may be selected such that a minimal gap is present between the cover portion 940 and the aperture 942 when the cover portion 940 occupies the aperture. Thus, when the cover portion 940 is present in the aperture 942, only the minimal gap between the components would be visible on the second surface 920, and all portions of the second latch part 916 would be recessed and concealed within the second structure 924 except for the cover portion 940. The exposed surface of the cover portion 940 may have a geometry that matches the geometry of the second surface 920, such that it is flush with respect to the second surface 920, leaving the second surface 920 generally free from interruptions.

In order to secure the second latch part 916 with respect to the first latch part 914, lock apertures 944 are formed through the bolt 936. The lock apertures 944 are sized, configured, and oriented such that the locking members 958 of the first latch part 914 may extend into the lock apertures 944 when the second latch part 916 is extended into the first latch part 914. The orientation of the lock apertures 944 may be selected to allow interaction with the locking members 958. In the illustrated example, four lock apertures 944 are formed through the tubular wall of the bolt 936 into the passage 956 transverse to the bolt axis, with the lock apertures 944 being spaced radially around the bolt axis at 90 degree intervals. The number and arrangement of the lock apertures 944 corresponds to the number and arrangement of the locking members 958, such that the second ends 964 of the locking members 958 may be pivoted into the lock apertures 944 of the bolt 936 when the bolt 936 is extended into the first latch part 914.

The locking members 958 may be extended and retracted by the actuator rod 954. An actuator assembly 948 is operable to cause movement of the actuator rod 954 axially relative to the bolt 936 when the bolt 936 is extended. This causes the end surface 955 of the actuator rod 954 to engage the first ends 962 of the locking members 958 to pivot the locking members 958. As the locking members 958 pivot, the first ends 962 of the locking members 958 pivot away from the bolt axis and the second ends 964 of the locking members 958 pivot toward the bolt axis and into the lock apertures 944 of the bolt 936. As the actuator rod 954 continues to extend, the first ends 962 of the locking members 958 transition from engagement with the end surface 955 of the actuator rod 954 to engagement with transverse side surfaces 966 of the actuator rod 954. While the first ends 962 of the locking members 958 are in engagement with the transverse side surfaces 966, the second ends 964 of the locking members 958 cannot be rotated away from the bolt axis and out of the lock apertures 944, which causes the locking members 958 to resist unintentional separation of the first and second latch parts 914, 916.

The second latch part 916 may include the actuator assembly 948, which may be similar to the actuator assembly 648, and is operable to move the bolt 936 along the bolt axis between the recessed and extended positions to cause engagement of the bolt 936 with respect the first latch part 914 as well as to drive extension and retraction of the actuator rod 954. Any type of device that is operable to cause movement of the bolt 936 and/or the actuator rod 954 may be used as the actuator assembly 948, such as a solenoid or a linear actuator, and the actuator assembly can be controlled by signals provided from an electronic control system using an electrical connection.

Figure 12:
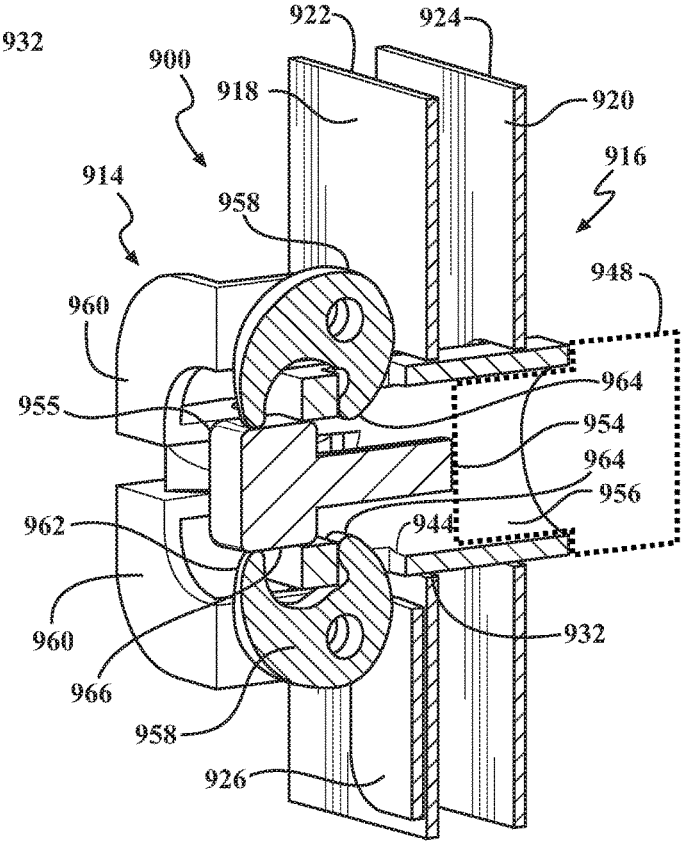
FIG. 12 is a cross-section perspective view showing the latch assembly according to the third example in a latched position.

The latch assembly 900 may be moved between an unlatched position (FIGS. 9-10) and a latched position (FIG. 12). The actuator assembly 948 is operable to move the second latch portion between the unlatched position and the latched position. To move the latch assembly 900 from the unlatched position the first and second structures 922, 924 are positioned adjacent to each other, such as in the closed position, with the first surface 918 facing the second surface 920 and the cover 926 in alignment with the cover portion 940, the bolt 936, and the bolt axis.

Figure 11:
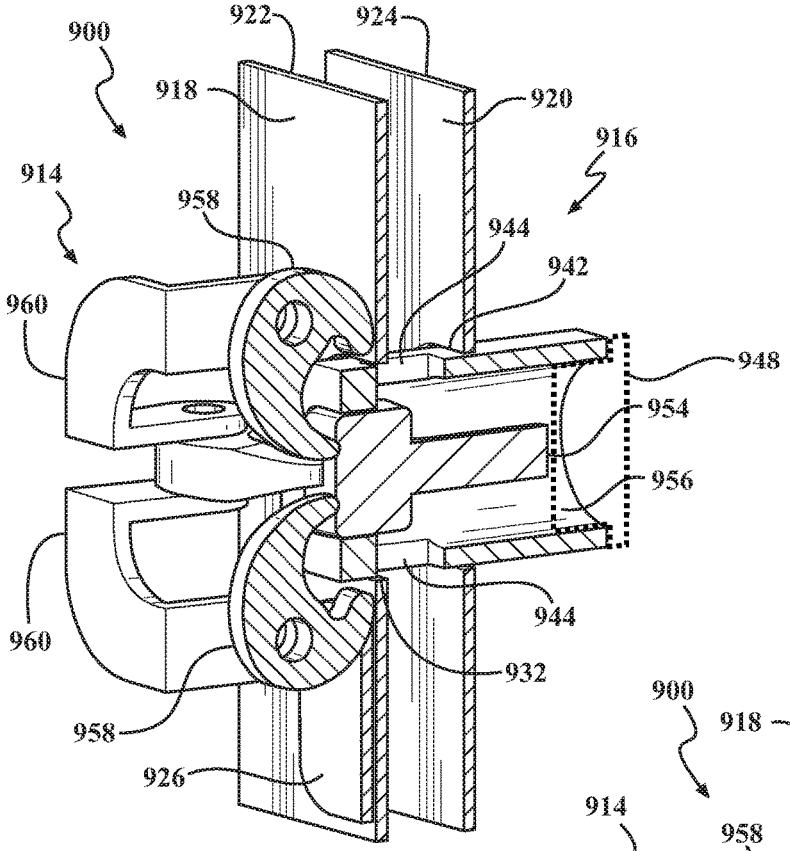
FIG. 11 is a cross-section perspective view showing the latch assembly according to the third example in an intermediate position.

First, the bolt 936 is moved along the bolt axis. Prior to or during to this initial movement of the bolt 936, the cover 926 is caused to move from the aperture 932 to a position in which it is not obstructing the aperture 932. The bolt 936 is moved from the recessed position to the extended position along the bolt axis, and the bolt 936 passes through the aperture 942 in the second surface 920 and the aperture 932 in the first surface 918 before reaching an intermediate position (FIG. 11). In the intermediate position, the first ends 962 of the locking members 958 come into contact with the end surface 955 of the actuator rod 954. The actuator rod 954 is then extended relative to the bolt 936, which in turn causes rotation of the locking members 958 which continues until the second ends 964 of the locking members 958 are seated in the lock apertures 944 of the bolt 936 and the locking members 958 are locked in place by engagement of the first ends 962 of the locking members 958 with the transverse side surfaces 966 of the actuator rod 954. Movement of the latch assembly 900 from the latched position to the unlatched position is performed in the same manner by reversing the operations.

Figure 13:
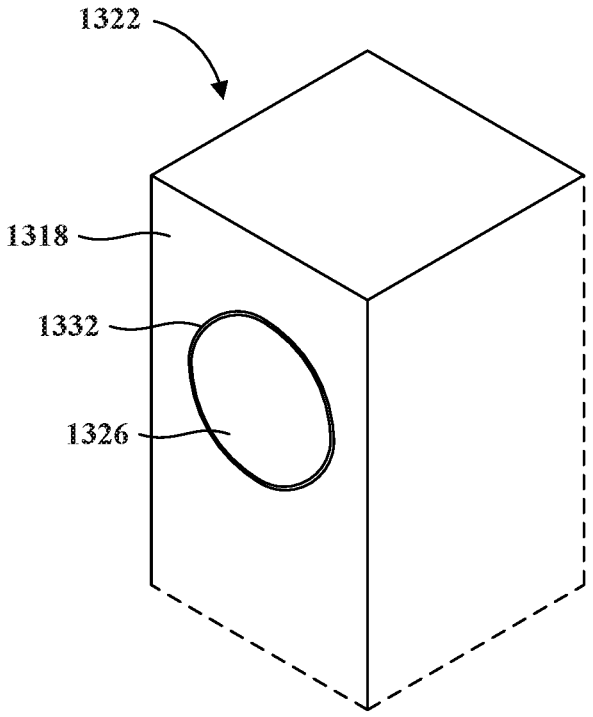
FIG. 13 is a perspective view showing a first structure.

FIG. 13 is a perspective view showing a first structure 1322. The first structure 1322 is analogous to the first structure 322 of the latch assembly 300, the first structure 622 of the latch assembly 600, and the first structure 922 of the latch assembly 900. A portion of a latch assembly may be concealed inside the first structure 1322, as explained in connection with the first latch part 314 of the latch assembly 300, the first latch part 614 of the latch assembly 600, and the first latch part 914 of the latch assembly 900.

The first structure 1322 includes a first surface 1318, an aperture 1332, and a cover 1326. The cover 1326 is able to occupy the aperture 1332 in order to conceal the portion of the latch assembly inside the first structure 1322.

A peripheral shape of the cover 1326 may be complementary to the shape of the interior periphery of the aperture 1332. In the illustrated example, the peripheral shape of the cover 1326 is circular and the shape of the interior periphery of the aperture 1332 is circular. The relative sizes of the cover 1326 and the aperture 1332 are selected such that a minimal gap is present between the cover 1326 and the aperture 1332 when the cover 1326 occupies the aperture. Thus, when the cover 1326 is present in the aperture 1332, only the minimal gap between the components would be visible on the first surface 1318, with the no portions of the latch assembly visible. The exposed surface of the cover 1326 may have a geometric configuration that matches the geometry of the first surface 1318, such that it is flush with respect to the first surface 1318, leaving the first surface 1318 generally free from interruptions. In the illustrated example, the cover 1326 is flat, and the area of the first surface 1318 that surrounds the cover 1326 is also flat. The geometric configurations for portions of the first structure 1322 including the first surface 1318, the aperture 1332, and the cover 1326 may be applied to any of the latch assemblies described herein, such as the latch assembly 300, the latch assembly 600, and the latch assembly 900.

Figure 14:
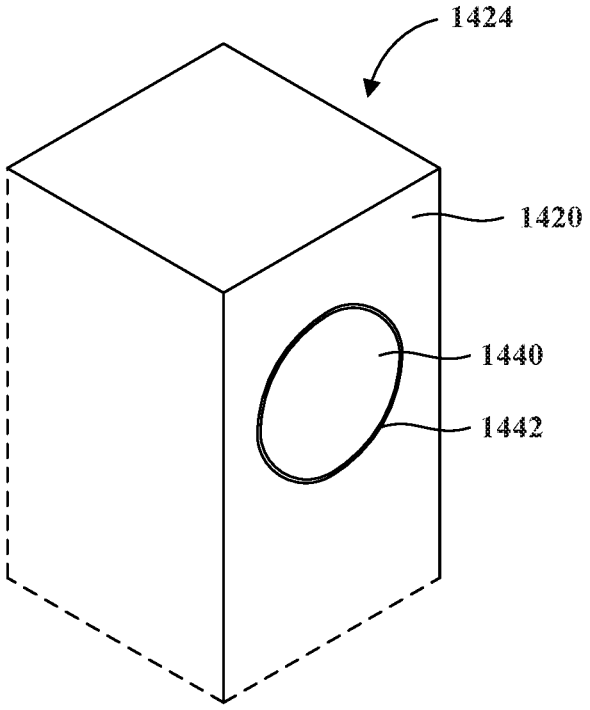
FIG. 14 is a perspective view showing a second structure.

FIG. 14 is a perspective view showing a second structure 1424. The second structure 1422 is analogous to the second structure 324 of the latch assembly 300, the second structure 624 of the latch assembly 600, and the second structure 924 of the latch assembly 900. A portion of a latch assembly may be concealed inside the second structure 1424, as explained in connection with the second latch part 316 of the latch assembly 300, the second latch part 616 of the latch assembly 600, and the second latch part 916 of the latch assembly 900.

The second structure 1424 includes a second surface 1420, an aperture 1442, and a cover 1440. The cover 1440 is able to occupy the aperture 1442 in order to conceal the portion of the latch assembly inside the second structure 1424.

A peripheral shape of the cover 1440 may be complementary to the shape of the interior periphery of the aperture 1442. In the illustrated example, the peripheral shape of the cover 1440 is circular and the shape of the interior periphery of the aperture 1442 is circular. The relative sizes of the cover 1440 and the aperture 1442 are selected such that a minimal gap is present between the cover 1440 and the aperture 1442 when the cover 1440 occupies the aperture. Thus, when the cover 1440 is present in the aperture 1442, only the minimal gap between the components would be visible on the second surface 1420, with the no portions of the latch assembly visible. The exposed surface of the cover 1326 may have a geometric configuration that matches the geometry of the second surface 1420, such that it is flush with respect to the second surface 1420, leaving the second surface 1420 generally free from interruptions. In the illustrated example, the cover 1440 is flat, and the area of the second surface 1420 that surrounds the cover 1440 is also flat. The geometric configurations for portions of the second structure 1424 including the second surface 1420, the aperture 1442, and the cover 1440 may be applied to any of the latch assemblies described herein, such as the latch assembly 300, the latch assembly 600, and the latch assembly 900.

The first structure 1322 and the second structure 1424 may be positioned with respect to one another such that their respective concealed latch portions may be deployed and connected, as explained with respect to the latch assembly 300, the latch assembly 600, and the latch assembly 900.

What is claimed is:

1. A vehicle, comprising:

a vehicle body portion that defines an opening;

a vehicle door that is movable between a closed position and an open position with respect to the opening;

a first surface and a second surface, wherein the first surface is defined on one of the vehicle body portion and the vehicle door and the second surface is defined on the other of the vehicle body portion and the vehicle door;

a first latch portion that is concealed behind the first surface;

a second latch portion that is concealed behind the second surface in an unlatched position and is movable to a latched position in which the second latch portion extends into the first latch portion and engages the first latch portion, wherein the second latch portion includes a bolt, an actuator rod that is located in a passage that is formed in the bolt, and a lock aperture that is formed in the bolt; and a locking structure that is pivotally mounted to the first latch portion, has a first end, has a second end, and restrains disengagement of the second latch portion from the first latch portion in the latched position, wherein movement from the unlatched position to the latched position includes an intermediate position, an end surface of the actuator rod contacts the first end of the locking structure in the intermediate position prior to extension of the actuator rod from the bolt, and the actuator rod is extended out of the bolt during movement from the intermediate position to the latched position so that a transverse side surface of the actuator rod contacts the first end of the locking structure and the second end of the locking structure is seated in the lock aperture of the bolt.

2. The vehicle of claim 1, further comprising:

a first aperture formed in the first surface;

a second aperture formed in the second surface;

a first cover that is disposed in the first aperture in the unlatched position; and a second cover that is disposed in the second aperture in the unlatched position.

3. The vehicle of claim 2, wherein first cover is moved out of the first aperture in the latched position and the second cover is moved out of the second aperture in the latched position.

4. The vehicle of claim 1, further comprising:

a first electronically-controlled actuator that is operable to move the second latch portion between the unlatched position and the latched position.

5. The vehicle of claim 4, wherein movement of the second latch portion from the unlatched position to the latched position causes engagement of the locking structure and movement of the second latch portion from the latched position to the unlatched position causes disengagement of the locking structure.

6. The vehicle of claim 1, wherein the second latch portion includes a bolt, the bolt includes lock apertures, the locking structure is connected to the first latch portion, and the locking structure engages the lock apertures of the bolt to restrain disengagement of the second latch portion from the first latch portion.

7. The vehicle of claim 6, wherein an actuator rod is located in the bolt and causes motion of the locking structure to engage and disengage the locking structure in the latched position.

8. A vehicle, comprising:

a vehicle body portion that defines an opening;

a vehicle door that is movable between a closed position and an open position with respect to the opening;

a first latch portion that is concealed behind the vehicle body portion;

a second latch portion that is concealed behind the vehicle door in an unlatched position and is movable to a latched position in which the second latch portion extends into the first latch portion and engages the first latch portion, wherein the second latch portion includes a bolt, an actuator rod that is located in a passage that is formed in the bolt, and a lock aperture that is formed in the bolt; and a locking structure that is pivotally mounted to the first latch portion, has a first end, has a second end, and restrains disengagement of the second latch portion from the first latch portion in the latched position, wherein movement from the unlatched position to the latched position includes an intermediate position, an end surface of the actuator rod contacts the first end of the locking structure in the intermediate position prior to extension of the actuator rod from the bolt, and the actuator rod is extended out of the bolt during movement from the intermediate position to the latched position so that a transverse side surface of the actuator rod contacts the first end of the locking structure and the second end of the locking structure is seated in the lock aperture of the bolt.

9. The vehicle of claim 8, further comprising:

a first aperture formed in the vehicle body portion;

a second aperture formed in the vehicle door;

a first cover that is disposed in the first aperture in the unlatched position; and a second cover that is disposed in the second aperture in the unlatched position.

10. The vehicle of claim 9, wherein first cover is moved out of the first aperture in the latched position and the second cover is moved out of the second aperture in the latched position.

11. The vehicle of claim 8, further comprising:

a first electronically-controlled actuator that is operable to move the second latch portion between the unlatched position and the latched position.

12. The vehicle of claim 11, wherein movement of the second latch portion from the unlatched position to the latched position causes engagement of the locking structure and movement of the second latch portion from the latched position to the unlatched position causes disengagement of the locking structure.

13. The vehicle of claim 8, wherein the second latch portion includes a bolt, the bolt includes lock apertures, the locking structure is connected to the first latch portion, and the locking structure engages the lock apertures of the bolt to restrain disengagement of the second latch portion from the first latch portion.

14. The vehicle of claim 13, wherein an actuator rod is located in the bolt and causes motion of the locking structure to engage and disengage the locking structure in the latched position.

15. A vehicle, comprising:

a vehicle body portion that defines an opening;

a vehicle door that is movable between a closed position and an open position with respect to the opening;

a first latch portion that is concealed behind the vehicle door;

a second latch portion that is concealed behind the vehicle body portion in an unlatched position and is movable to a latched position in which the second latch portion extends into the first latch portion and engages the first latch portion, wherein the second latch portion includes a bolt, an actuator rod that is located in a passage that is formed in the bolt, and a lock aperture that is formed in the bolt; and a locking structure that is pivotally mounted to the first latch portion, has a first end, has a second end, and restrains disengagement of the second latch portion from the first latch portion in the latched position, wherein movement from the unlatched position to the latched position includes an intermediate position, an end surface of the actuator rod contacts the first end of the locking structure in the intermediate position prior to extension of the actuator rod from the bolt, and the actuator rod is extended out of the bolt during movement from the intermediate position to the latched position so that a transverse side surface of the actuator rod contacts the first end of the locking structure and the second end of the locking structure is seated in the lock aperture of the bolt.

16. The vehicle of claim 15, further comprising:

a first aperture formed in the vehicle body portion;

a second aperture formed in the vehicle door;

a first cover that is disposed in the first aperture in the unlatched position; and a second cover that is disposed in the second aperture in the unlatched position.

17. The vehicle of claim 16, wherein first cover is moved out of the first aperture in the latched position and the second cover is moved out of the second aperture in the latched position.

18. The vehicle of claim 15, further comprising:

a first electronically-controlled actuator that is operable to move the second latch portion between the unlatched position and the latched position.

19. The vehicle of claim 18, wherein movement of the second latch portion from the unlatched position to the latched position causes engagement of the locking structure and movement of the second latch portion from the latched position to the unlatched position causes disengagement of the locking structure.

20. The vehicle of claim 15, wherein the second latch portion includes a bolt, the bolt includes lock apertures, the locking structure is connected to the first latch portion, and the locking structure engages the lock apertures of the bolt to restrain disengagement of the second latch portion from the first latch portion.

21. The vehicle of claim 20, wherein an actuator rod is located in the bolt and causes motion of the locking structure to engage and disengage the locking structure in the latched position.

* * * * *